US007667662B2

(12) United States Patent
Chiang

(10) Patent No.: US 7,667,662 B2
(45) Date of Patent: Feb. 23, 2010

(54) ANTENNA

(75) Inventor: Yuh-Yuh Chiang, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 22 days.

(21) Appl. No.: 12/172,879

(22) Filed: Jul. 14, 2008

(65) Prior Publication Data

US 2009/0195458 A1 Aug. 6, 2009

(30) Foreign Application Priority Data

Jan. 31, 2008 (TW) ..... 97202097 U

(51) Int. Cl.
*H01Q 1/24* (2006.01)

(52) U.S. Cl. ..... 343/846; 343/702; 343/828

(58) Field of Classification Search ..... 343/700 MS, 343/702, 828, 846, 893
See application file for complete search history.

(56) References Cited

U.S. PATENT DOCUMENTS 6,483,462 B2 * 11/2002 Weinberger ..... 343/700 MS
6,812,892 B2 11/2004 Tai et al.
6,891,504 B2 5/2005 Cheng et al.
6,999,037 B2 * 2/2006 Apostolos ..... 343/767
7,161,543 B2 1/2007 Cheng et al.
2007/0103367 A1 * 5/2007 Wang ..... 343/700 MS

* cited by examiner

*Primary Examiner*—Michael C Wimer
(74) *Attorney, Agent, or Firm*—Quintero Law Office

(57) ABSTRACT

An antenna is provided. The antenna has a ground element, a radiator and a conductive element. The radiator has a body, wherein the body has a first edge, a second edge, a third edge and a fourth edge, and the first edge is parallel to the third edge, a length of the first edge is shorter than a length of the third edge, the first edge is close to the ground element, the second edge connects the first edge and the third edge, a fourth edge connects the first edge and the third edge, and a first slot is formed on the radiator. The second edge and the fourth edge extend separately from the first edge to the third edge. The conductive element connects the ground element and the radiator.

32 Claims, 10 Drawing Sheets

204

ANTENNA

CROSS REFERENCE TO RELATED APPLICATIONS

This Application claims priority of Taiwan Patent Application No. 97202097, filed on Jan. 31, 2008, the entirety of which is incorporated by reference herein.

BACKGROUND OF THE INVENTION

1. Field of the Invention

The invention relates to an antenna, and more particularly to an antenna with increased bandwidth.

2. Description of the Related Art

U.S. Pat. No. 6,812,892, U.S. Pat. No. 7,161,543 and U.S. Pat. No. 6.891.504 disclose three conventional antennas, wherein the conventional antennas have narrow bandwidths, and cannot satisfy present transmission requirements. For example, FIG. 1*a* shows a conventional antenna 1 disclosed in U.S. Pat. No. 6,812,892, which has a ground element 10, a conductive element 20 and a radiator 30. The conductive element 20 is connected to the ground element 10. The radiator 30 is connected to the conductive element 20. A coaxial cable 40 is electrically connected to the ground element 10 and the conductive element 20. The radiator 30 has a first section 31 and a second section 32. The first section 31 transmits a high frequency signal, and the second section 32 transmits a low frequency signal.

FIG. 1*b* shows signal transmission of the conventional antenna 1, wherein the bandwidth of the antenna 1 (bandwidth is defined as signals having voltage standing wave ratio less than 2) is between about 2.39 GHz to 2.53 GHz and between 4.84 GHz to 5.80 GHz. The conventional antennas have narrow bandwidth, and cannot satisfy present transmission requirements.

BRIEF SUMMARY OF THE INVENTION

A detailed description is given in the following embodiments with reference to the accompanying drawings.

An antenna is provided. The antenna has a ground element, a radiator and a conductive element. The radiator has a body, wherein the body has a first edge, a second edge, a third edge and a fourth edge, the first edge is parallel to the third edge, a length of the first edge is shorter than a length of the third edge, the first edge is close to the ground element, the second edge connects the first edge and the third edge, a fourth edge connects the first edge and the third edge, and a first slot is formed on the radiator. The second edge and the fourth edge extend separately from the first edge to the third edge. The conductive element connects the ground element and the radiator.

The antennas of the embodiments of the invention provide wider bandwidth and improved transmission with decreased antenna dimension.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
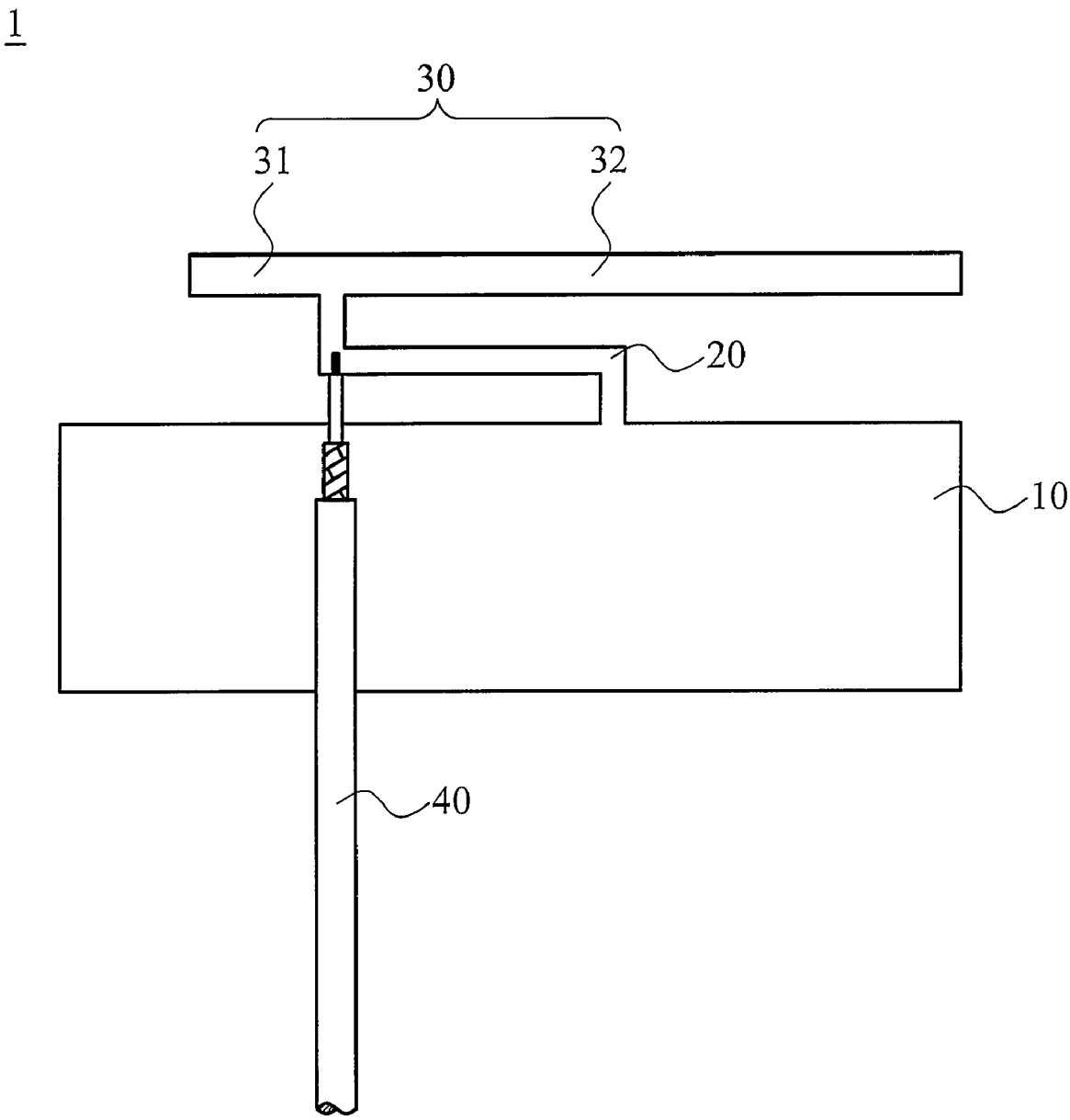
FIG. 1a (PRIOR ART)
FIG. 1*a* shows a conventional antenna disclosed in U.S. Pat. No. 6,812,892.
Figure 1B:
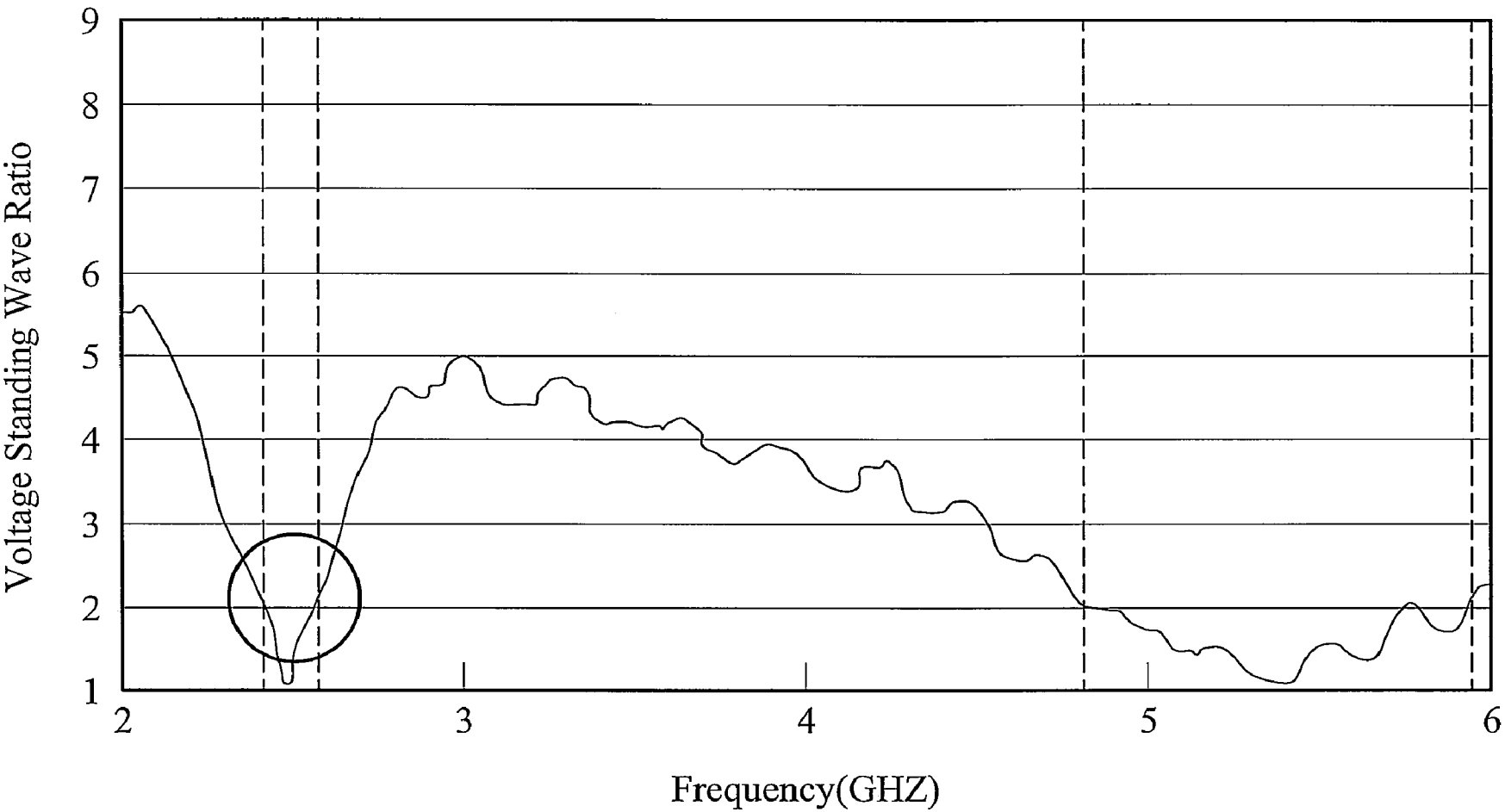
FIG. 1b (PRIOR ART)
FIG. 1*b* shows signal transmission of the conventional antenna in FIG. 1*a;*
Figure 2A:
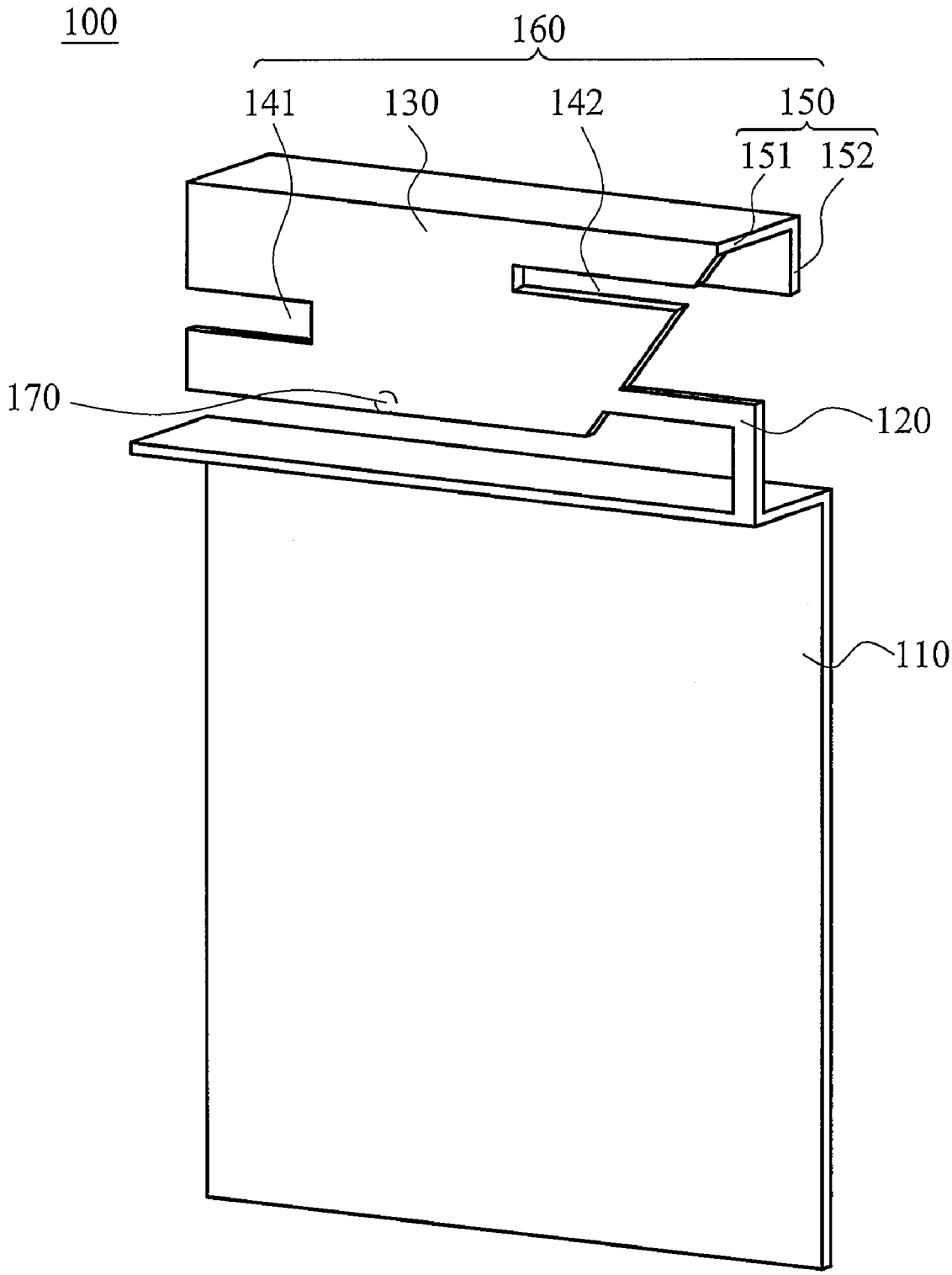
FIG. 2*a* is a perspective view of an antenna of a first embodiment of the invention.
Figure 2B:
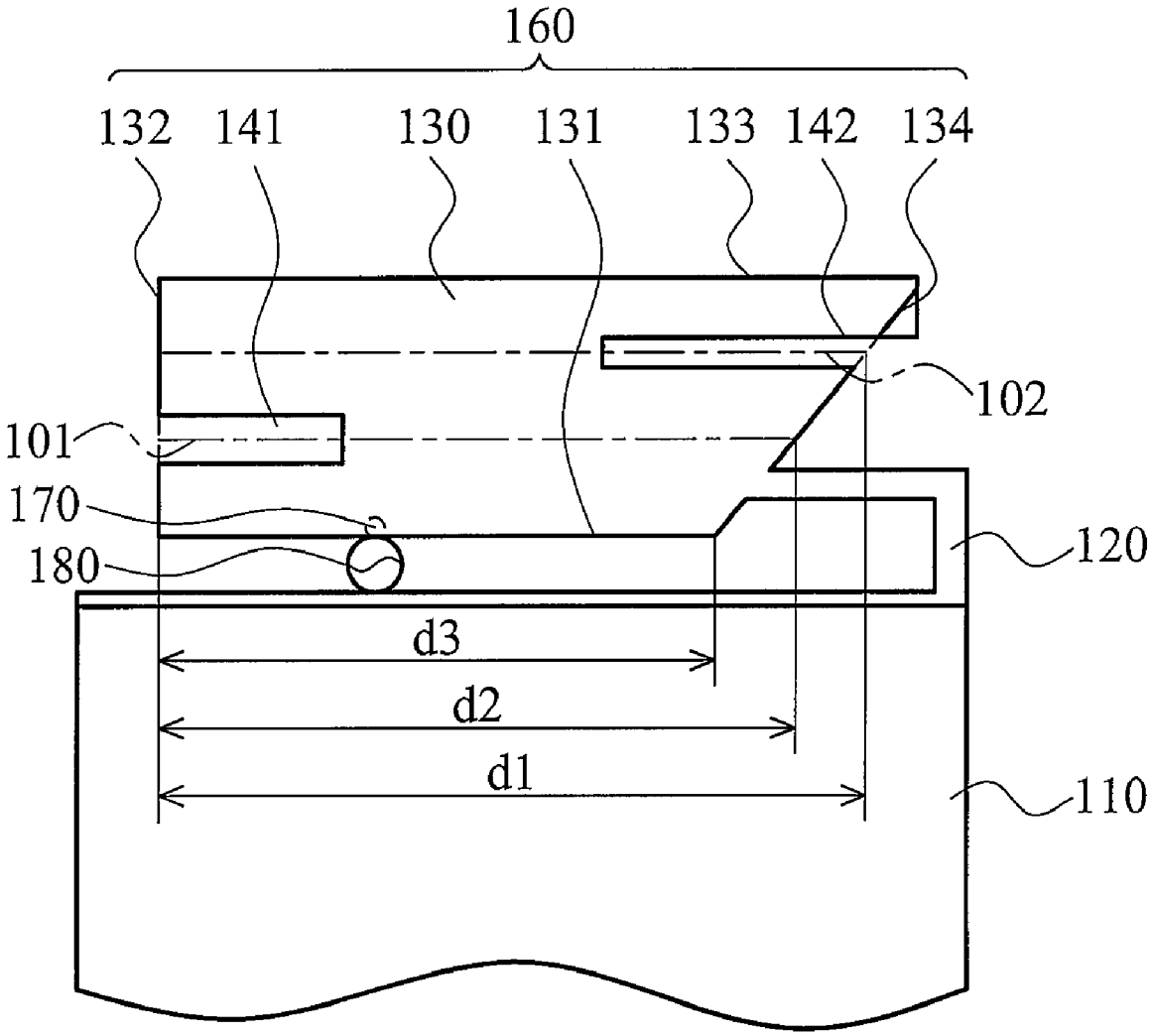
FIG. 2*b* is a front view of the antenna of the first embodiment of the invention.

FIG. 2*a* is a perspective view of an antenna 100 of a first embodiment of the invention, and FIG. 2*b* is a front view of the antenna 100 of the first embodiment of the invention. With reference to FIG. 2*a* and 2*b,* the antenna 100 has a ground element 110, a conductive element 120 and a radiator 160. The conductive element 120 is connected to the ground element 110 and the radiator 160. The radiator 160 has a body 130, a first slot 141, a second slot 142 and an extending portion 150. The body 130 has a first edge 131, a second edge 132, a third edge 133 and a fourth edge 134. The first edge 131 is parallel to the third edge 133. The length of the first edge 131 is shorter than the length of the third edge 133. The first edge 131 is close to the ground element 110. The second edge 132 connects the first edge 131 and the third edge 133. The fourth edge 134 connects the first edge 131 and the third edge 133. The second edge 132 and the fourth edge 134 extend separately from the first edge 131 to the third edge 133.

The first slot 141 is formed on the second edge 132. The first slot 141 extends parallel to the first edge 131. The antenna 100 further has a first datum line 101. The first datum line 101 extends from the second edge 132 to the fourth edge 134. The first datum line 101 is parallel to the first edge 131. The first slot 141 extends along the first datum line 101. The length of the first slot 141 is not longer than half the length d2 of the first datum line 101.

The second slot 142 is formed on the fourth edge 134. The second slot 142 extends parallel to the first edge 131. The antenna 100 further has a second datum line 102. The second datum line 102 extends from the second edge 132 to the fourth edge 134. The second datum line 102 is parallel to the first edge 131. The second slot 142 extends along the second datum line 102. The length of the second slot 142 is not longer than half the length d1 of the second datum line 102.

The conductive element 120 is connected to the fourth edge 134. The antenna 100 further has a feed point 170. The feed point 170 is located on the first edge 131. A coaxial cable 180 feeds the radiator 160 at the feed point 170. The distance between the feed point 170 and the second edge 132 is not longer than half the length d3 of the first edge 131.

With reference to FIG. 2*a* and 2*b*, the extending portion 150 is connected to the third edge 133. The extending portion 150 has a first section 151 and a second section 152. The first section 151 is perpendicular to the second section 152. The first section 151 is connected to the body 130 and perpendicular thereto. The second section 152 is connected to the first section 151 and parallel to the body 130.

In the first embodiment, a width of the first slot 141 is about 1.5 mm, and a width of the second slot 142 is about 1 mm. However, the dimensional description does not limit the scope of the invention.

Figure 3:
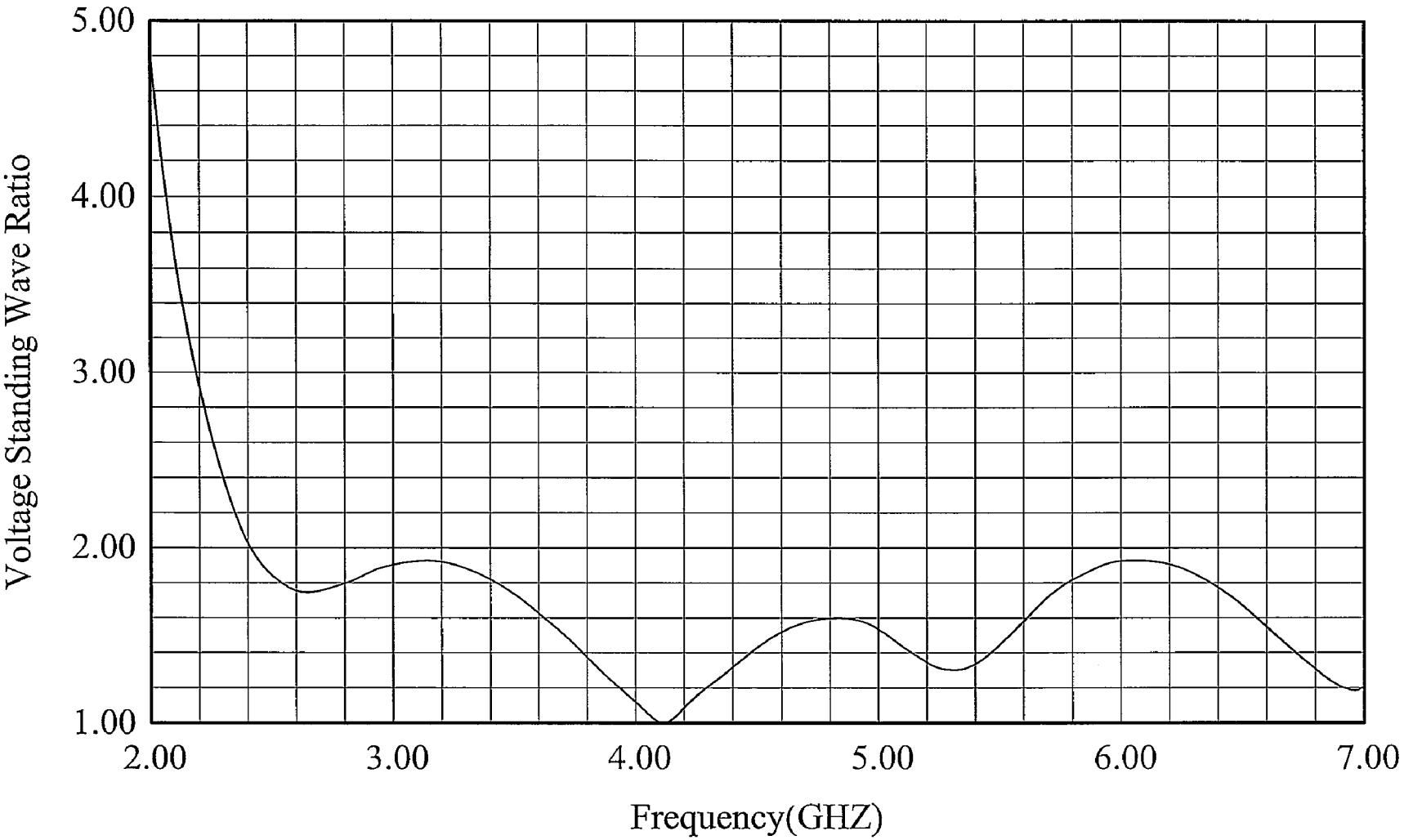
FIG. 3 shows signal transmission of the antenna of the first embodiment of the invention.

FIG. 3 shows signal transmission of the antenna 100 of the first embodiment of the invention, wherein the bandwidth of the antenna 100 (bandwidth is defined as signals having voltage standing wave ratio less than 2) is between 2.45 GHz to 7 GHz. Therefore, the antenna 100 of the embodiment provides wider bandwidth and improved transmission with decreased antenna dimension.

Figure 4A:
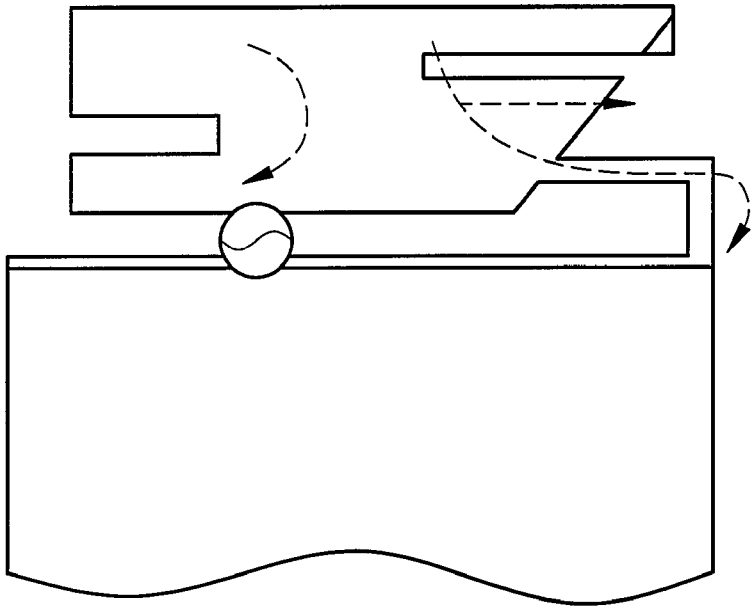
FIG. 4*a* shows signal transmission path of a first wireless signal (2.55 GHz)
Figure 4B:
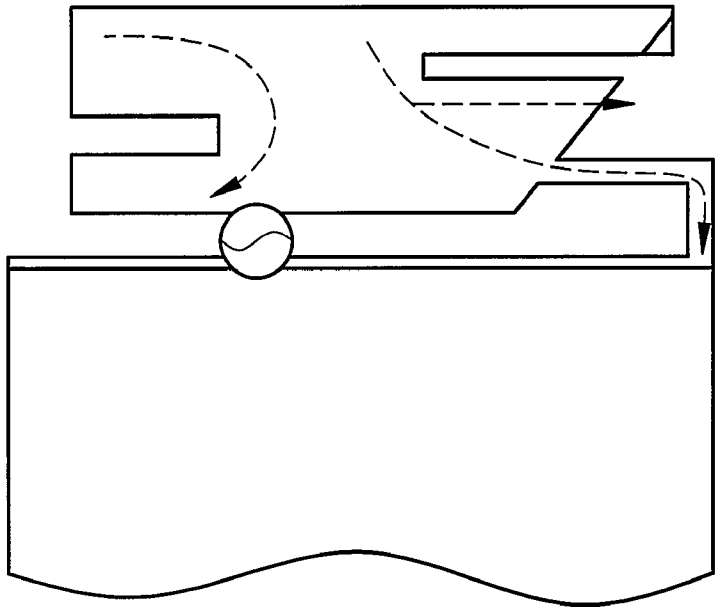
FIG. 4*b* shows signal transmission path of a second wireless signal (4 GHz)
Figure 4C:
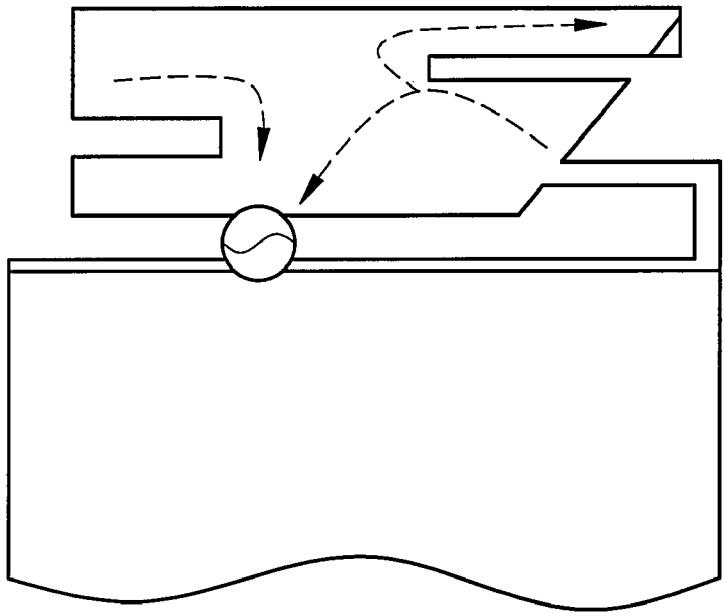
FIG. 4*c* shows signal transmission path of a third wireless signal (5.05 GHz)
Figure 4D:
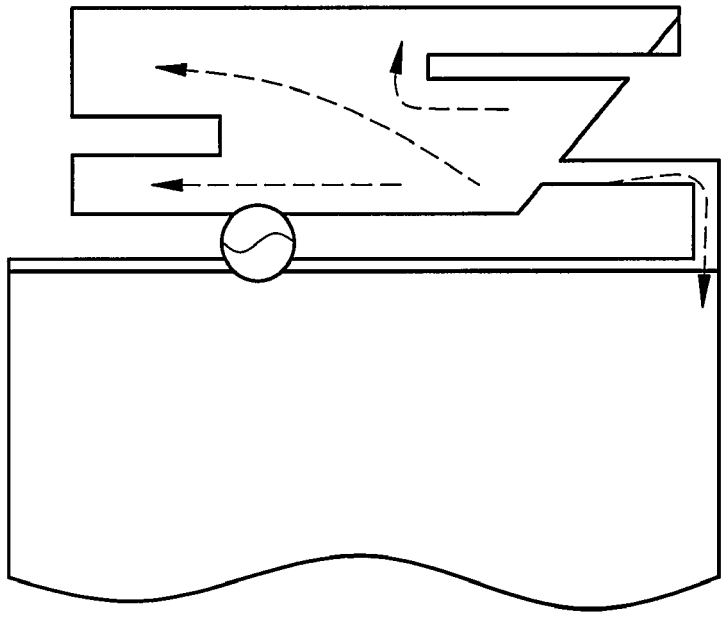
FIG. 4*d* shows signal transmission path of a first wireless signal (6.75 GHz)

FIGS. 4*a* to 4*d* shows signal transmission path in the first embodiment of the invention. FIG. 4*a* shows signal transmission path of a first wireless signal (2.55 GHz). FIG. 4*b* shows signal transmission path of a second wireless signal (4 GHz). FIG. 4*c* shows signal transmission path of a third wireless signal (5.05 GHz). FIG. 4*d* shows signal transmission path of a first wireless signal (6.75 GHz).

Figure 5:
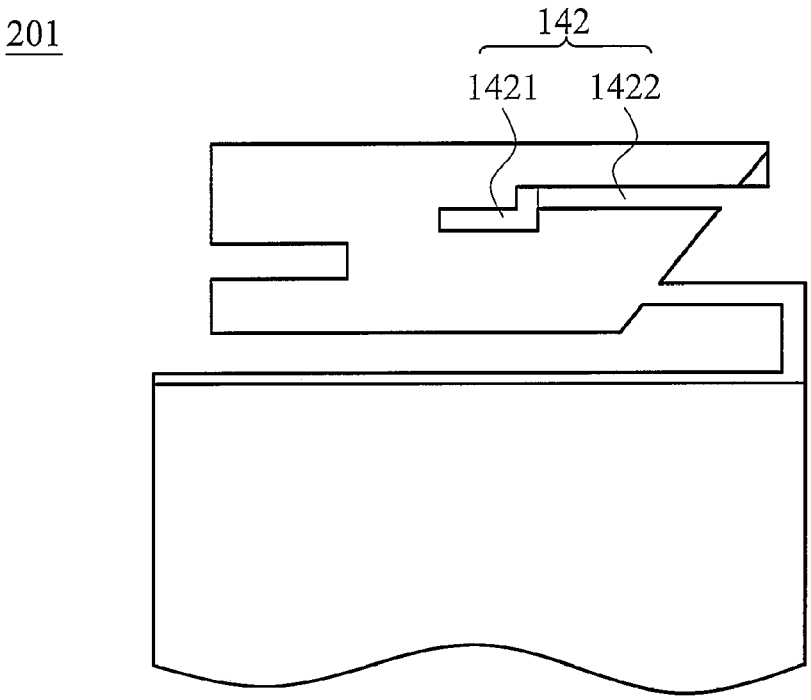
FIG. 5 shows an antenna of a second embodiment of the invention.

FIG. 5 shows an antenna 201 of a second embodiment of the invention, wherein the second slot further has an L-shaped section 1421 and a straight section 1422. The L-shaped section 1421 is connected to the straight section 1422. In a modified example, the first slot can further have an L-shaped section and a straight section, and the L-shaped section is connected to the straight section.

Figure 6:
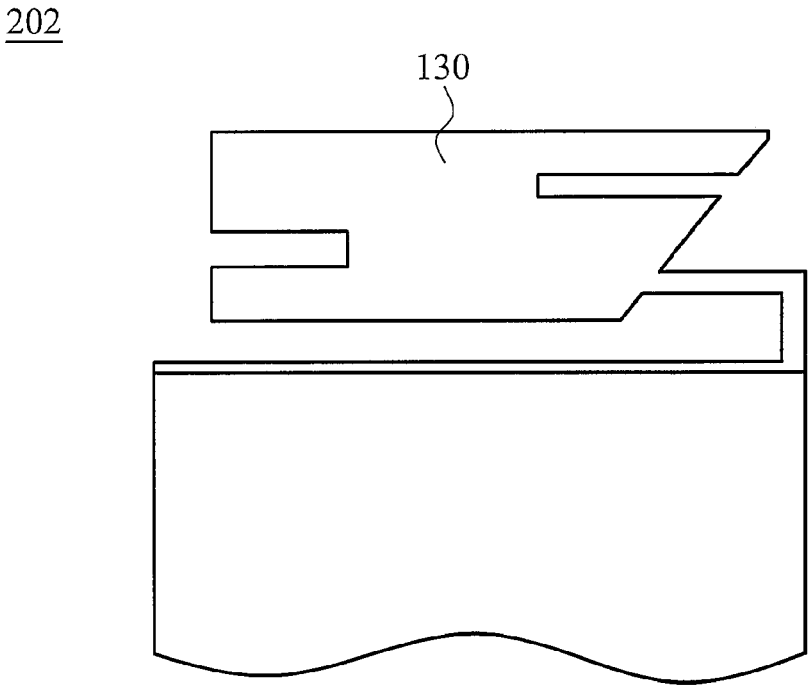
FIG. 6 shows an antenna of a third embodiment of the invention.

FIG. 6 shows an antenna 202 of a third embodiment of the invention, wherein the extending portion is omitted, and the radiator 202 transmits wireless signals simply via the body 130.

Figure 7A:
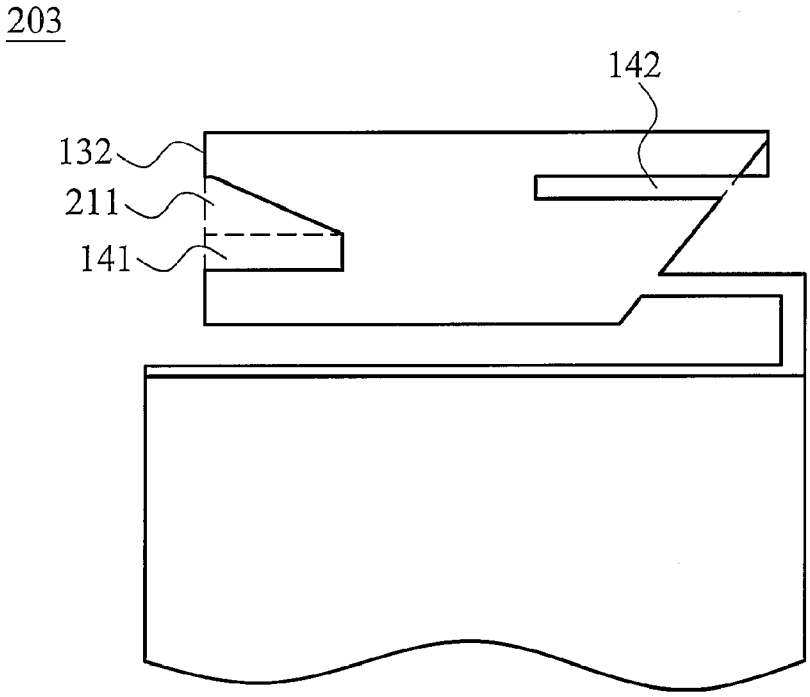
FIG. 7*a* shows an antenna of a fourth embodiment of the invention.
Figure 7B:
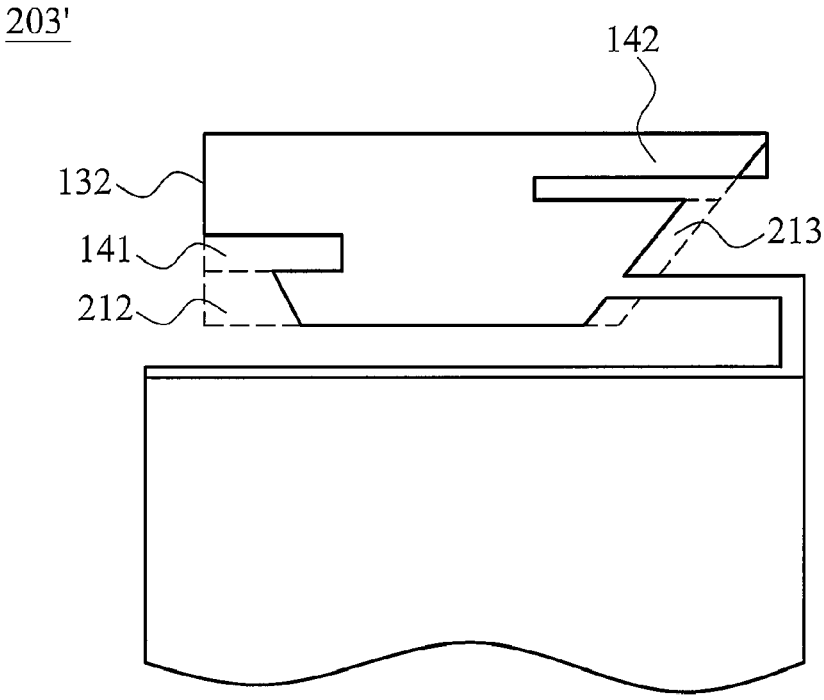
FIG. 7*b* shows an antenna of a modified example of the fourth embodiment of the invention.

FIG. 7*a* shows an antenna 203 of a fourth embodiment of the invention, wherein a notch 211 is formed on the radiator. The notch 211 is located on the second edge 132, and connected to the first slot 141. The notch 211 is substantially triangular shaped. FIG. 7*b* shows an antenna 203' of a modified example of the fourth embodiment of the invention, wherein a notch 212 and a notch 213 are formed on the radiator. The notch 212 is trapezoid and connected to the first slot 141. The notch 213 is parallelogram shaped and connected to the second slot 142. In the embodiments of the invention, the shape of the notches can be modified.

Figure 8:
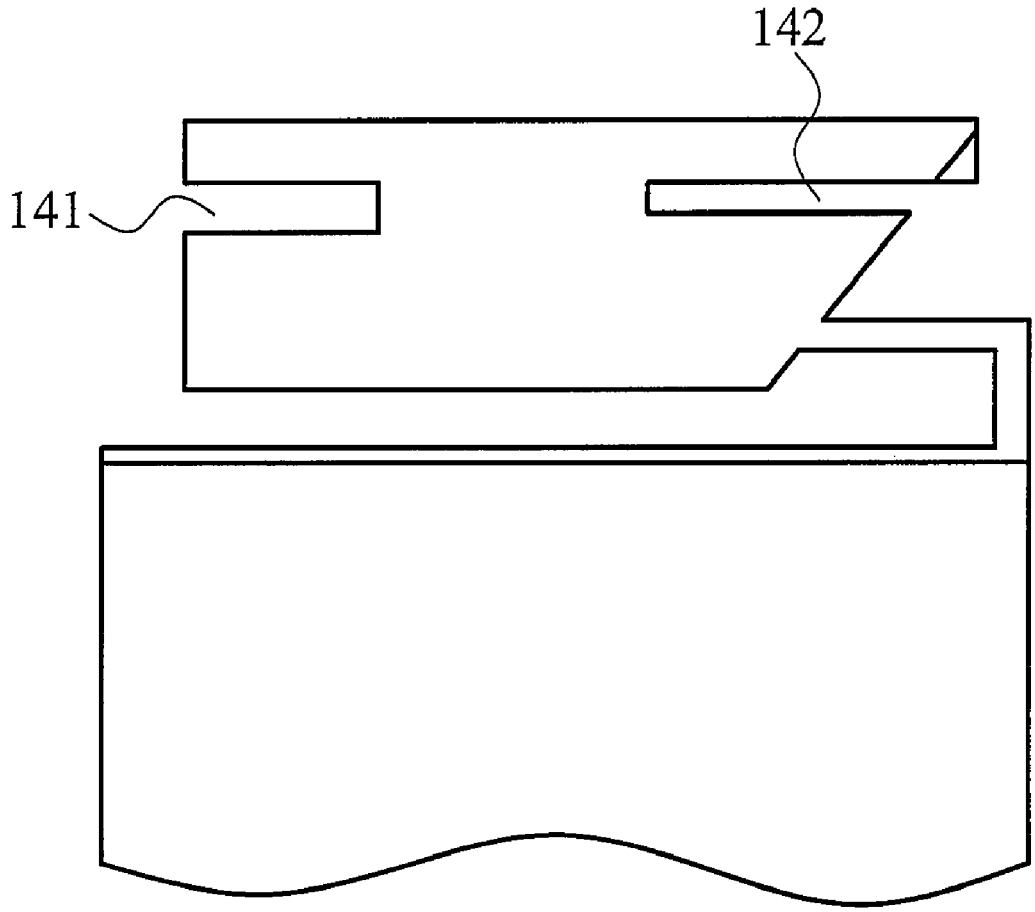
FIG. 8 shows an antenna of a fifth embodiment of the invention.

FIG. 8 shows an antenna 204 of a fifth embodiment of the invention, wherein locations of the first groove 141 and the second groove 142 can be modified to satisfy various signal transmission requirements.

In the embodiments of the invention, the second edge 132 is perpendicular to the first edge 131. However, the invention is not limited thereby. Additionally, the body can be various polygon shapes, and is not limited to be a trapezoid shape.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a ground element;

a radiator, having a body, wherein the body has a first edge, a second edge, a third edge and a fourth edge, and the first edge is parallel to the third edge, a length of the first edge is shorter than a length of the third edge, the first edge is close to the ground element, the second edge connects the first edge and the third edge, a fourth edge connects the first edge and the third edge, and a first slot is formed on the radiator; and a conductive element, connecting the ground element and the radiator.

2. The antenna as claimed in claim 1, wherein the first slot is formed on the second edge, and the first slot extends parallel to the first edge.

3. The antenna as claimed in claim 2, further having a first datum line extending from the second edge to the fourth edge and parallel to the first edge, wherein the first slot extends along the first datum line, and a length of the first slot equals to half the length of the first datum line.

4. The antenna as claimed in claim 2, further having a first datum line extending from the second edge to the fourth edge and parallel to the first edge, wherein the first slot extends along the first datum line, and a length of the first slot is shorter than half the length of the first datum line.

5. The antenna as claimed in claim 2, wherein a second slot is formed on the fourth edge of the radiator, and the second slot extends parallel to the first edge.

6. The antenna as claimed in claim 5, further having a second datum line extending from the second edge to the fourth edge and parallel to the first edge, wherein the second slot extends along the second datum line, and a length of the second slot equals to half the length of the second datum line.

7. The antenna as claimed in claim 5, further having a second datum line extending from the second edge to the fourth edge and parallel to the first edge, wherein the second slot extends along the second datum line, and a length of the second slot is shorter than half the length of the second datum line.

8. The antenna as claimed in claim 1, further having a feed point located on the first edge.

9. The antenna as claimed in claim 8, wherein the conductive element is connected to the fourth edge, and a distance between the feed point and the second edge equals to half the length of the first edge.

10. The antenna as claimed in claim 8, wherein the conductive element is connected to the fourth edge, and a distance between the feed point and the second edge is shorter than half the length of the first edge.

11. The antenna as claimed in claim 1, wherein the second edge is perpendicular to the first edge.

12. The antenna as claimed in claim 1, wherein a notch is formed on the second edge of the radiator connected to the first slot.

13. The antenna as claimed in claim 12, wherein the notch is triangular shaped.

14. The antenna as claimed in claim 12, wherein the notch is trapezoid shaped.

15. The antenna as claimed in claim 1, wherein the radiator further has an extending portion connected to the third edge, the extending portion has a first section and a second section, the first section is perpendicular to the second section, the first section is connected to the body and perpendicular thereto, and the second section is connected to the first section and parallel to the body.

16. The antenna as claimed in claim 1, wherein the first slot has an L-shaped section and a straight section, and the L-shaped section is connected to the straight section.

17. An antenna, comprising:

a ground element;

a radiator, having a body, wherein the body has a first edge, a second edge, a third edge and a fourth edge, and the first edge is parallel to the third edge, a length of the first edge is shorter than a length of the third edge, a first edge is close to the ground element, the second edge and the fourth edge extend separately from the first edge to the third edge, and a first slot is formed on the radiator; and a conductive element, connecting the ground element and the radiator.

18. The antenna as claimed in claim 17, wherein the body is polygon shaped.

19. The antenna as claimed in claim 17, wherein the first slot is formed on the second edge, and the first slot extends parallel to the first edge.

20. The antenna as claimed in claim 19, further having a first datum line extending from the second edge to the fourth edge and parallel to the first edge, wherein the first slot extends along the first datum line, and a length of the first slot equals to half the length of the first datum line.

21. The antenna as claimed in claim 19, further having a first datum line extending from the second edge to the fourth edge and parallel to the first edge, wherein the first slot extends along the first datum line, and a length of the first slot is shorter than half the length of the first datum line.

22. The antenna as claimed in claim 19, wherein a second slot is formed on the fourth edge of the radiator, and the second slot extends parallel to the first edge.

23. The antenna as claimed in claim 22, further having a second datum line extending from the second edge to the fourth edge and parallel to the first edge, wherein the second slot extends along the second datum line, and a length of the second slot equals to half the length of the second datum line.

24. The antenna as claimed in claim 22, further having a second datum line extending from the second edge to the fourth edge and parallel to the first edge, wherein the second slot extends along the second datum line, and a length of the second slot is shorter than half the length of the second datum line.

25. The antenna as claimed in claim 17, further having a feed point located on the first edge.

26. The antenna as claimed in claim 25, wherein the conductive element is connected to the fourth edge, and a distance between the feed point and the second edge equals to half the length of the first edge.

27. The antenna as claimed in claim 25, wherein the conductive element is connected to the fourth edge, and a distance between the feed point and the second edge is shorter than half the length of the first edge.

28. The antenna as claimed in claim 17, wherein a notch is formed on the second edge of the radiator connected to the first slot.

29. The antenna as claimed in claim 28, wherein the notch is triangular shaped.

30. The antenna as claimed in claim 28, wherein the notch is trapezoid shaped.

31. The antenna as claimed in claim 17, wherein the radiator further has an extending portion connected to the third edge, the extending portion has a first section and a second section, the first section is perpendicular to the second section, the first section is connected to the body and perpendicular thereto, and the second section is connected to the first section and parallel to the body.

32. The antenna as claimed in claim 17, wherein the first slot has an L-shaped section and a straight section, and the L-shaped section is connected to the straight section.

* * * * *